US008056936B2

(12) United States Patent
Peng

(10) Patent No.: US 8,056,936 B2
(45) Date of Patent: Nov. 15, 2011

(54) TELESCOPIC PIPE STRUCTURE FOR A MARINE LIGHT

(76) Inventor: I-Sin Peng, Taichung (TW)

( * ) Notice: Subject to any disclaimer, the term of this patent is extended or adjusted under 35 U.S.C. 154(b) by 0 days.

(21) Appl. No.: 12/407,436

(22) Filed: Mar. 19, 2009

(65) Prior Publication Data

US 2011/0084481 A1 Apr. 14, 2011

(51) Int. Cl.
*F16L 15/02* (2006.01)

(52) U.S. Cl. ..... 285/302; 285/390

(58) Field of Classification Search ..... 285/302, 285/290

See application file for complete search history.

(56) References Cited

U.S. PATENT DOCUMENTS 5,836,620 A * 11/1998 Wang et al. ..... 285/7

* cited by examiner

*Primary Examiner* — Aaron Dunwoody
(74) *Attorney, Agent, or Firm* — Jackson IPG PLLC; Demian K. Jackson

(57) ABSTRACT

A telescopic pipe structure for a marine light includes a telescopic pipe and a positioning device. The telescopic pipe includes a second pipe and a fixed pipe. The positioning device is used to control the telescopic pipe in a fixed status or in an adjustable status. The positioning device includes a rotatable lid, a resilient sleeve, and a metallic ring. When the rotatable lid is turned clockwise or counterclockwise, the metallic ring will be pushed by the top of the fixed tube or returned to its original position by the resilient sleeve for controlling the engagement or disengagement of an contracted opening of the resilient sleeve and the second pipe so as to change the telescopic pipe in a fixed status or in an adjustable status.

3 Claims, 9 Drawing Sheets

-Prior Art-

-Prior Art-

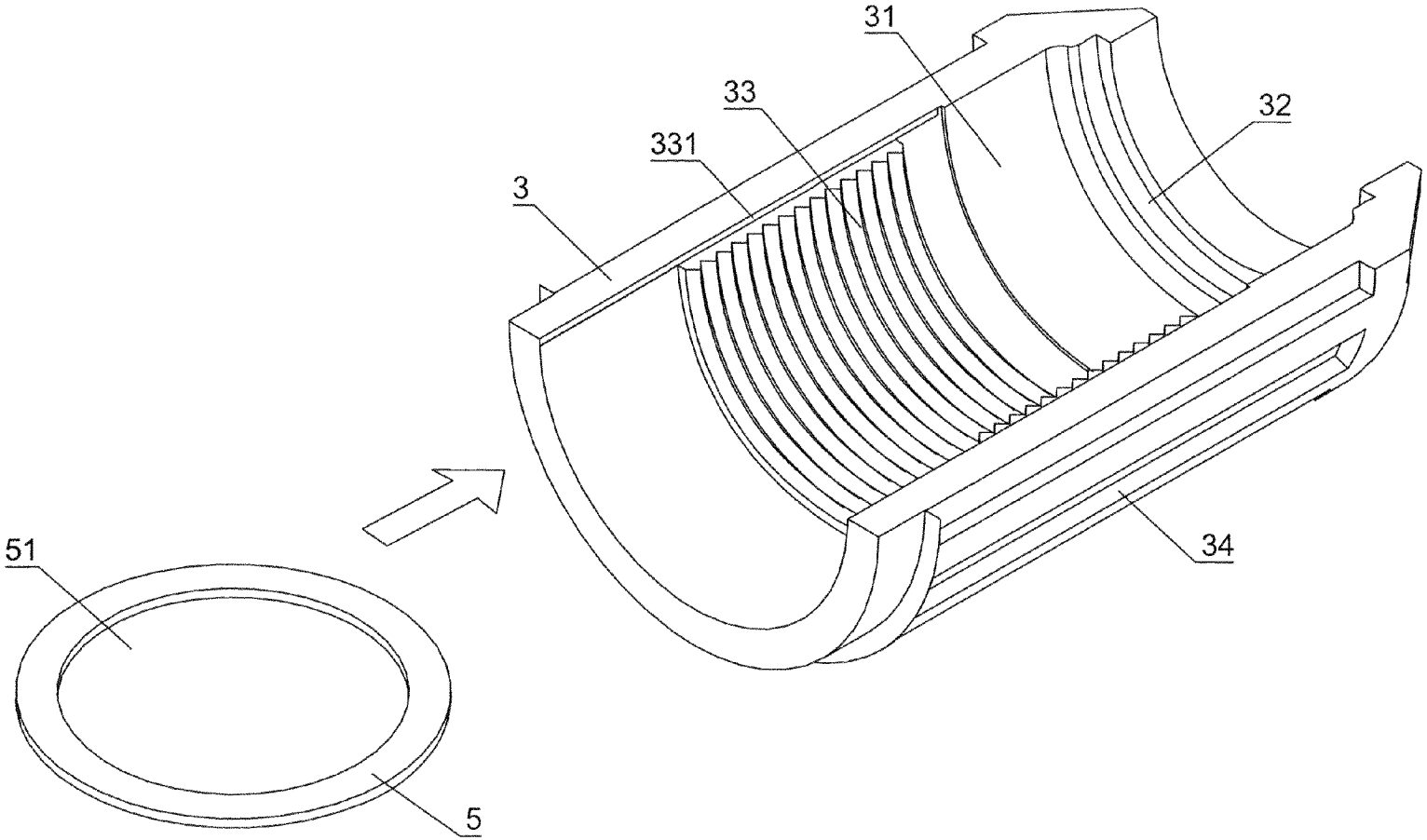
Fig. 6-A

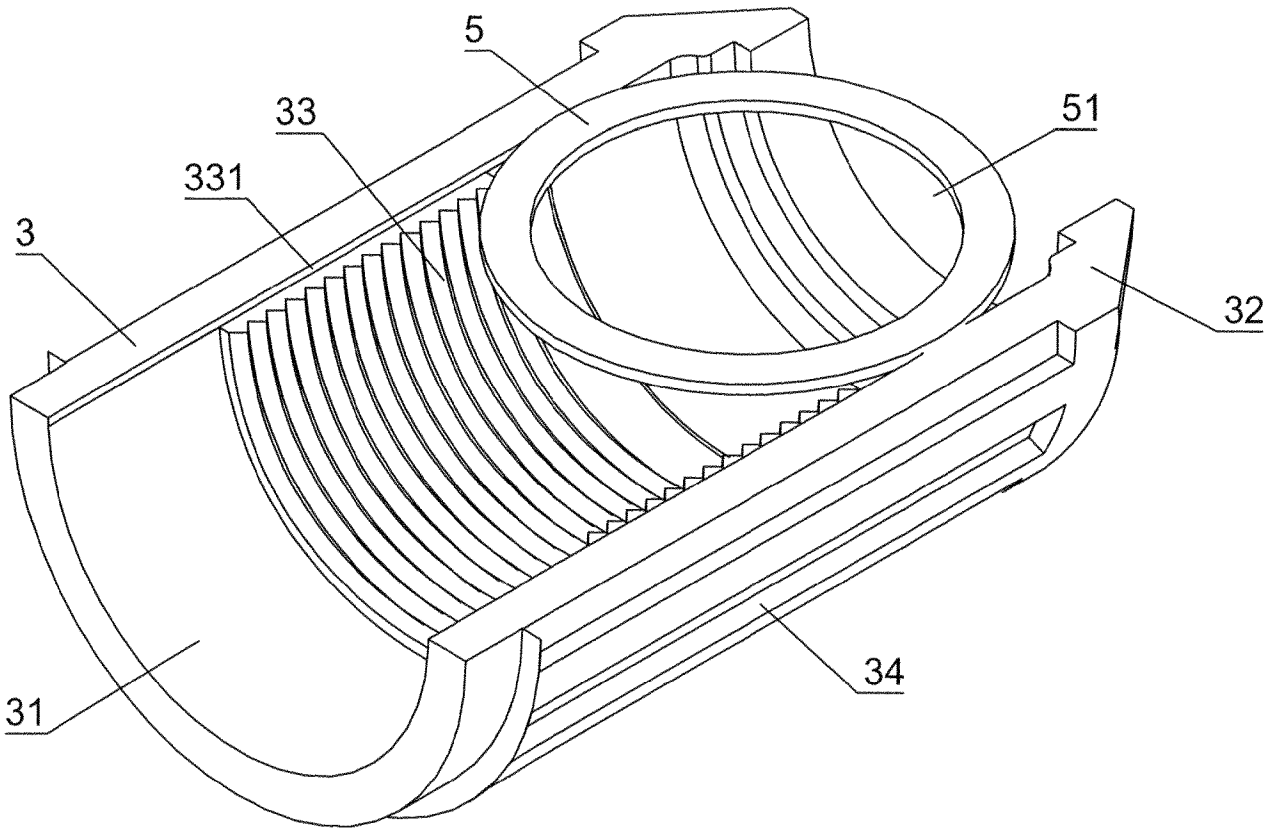
Fig. 6-B

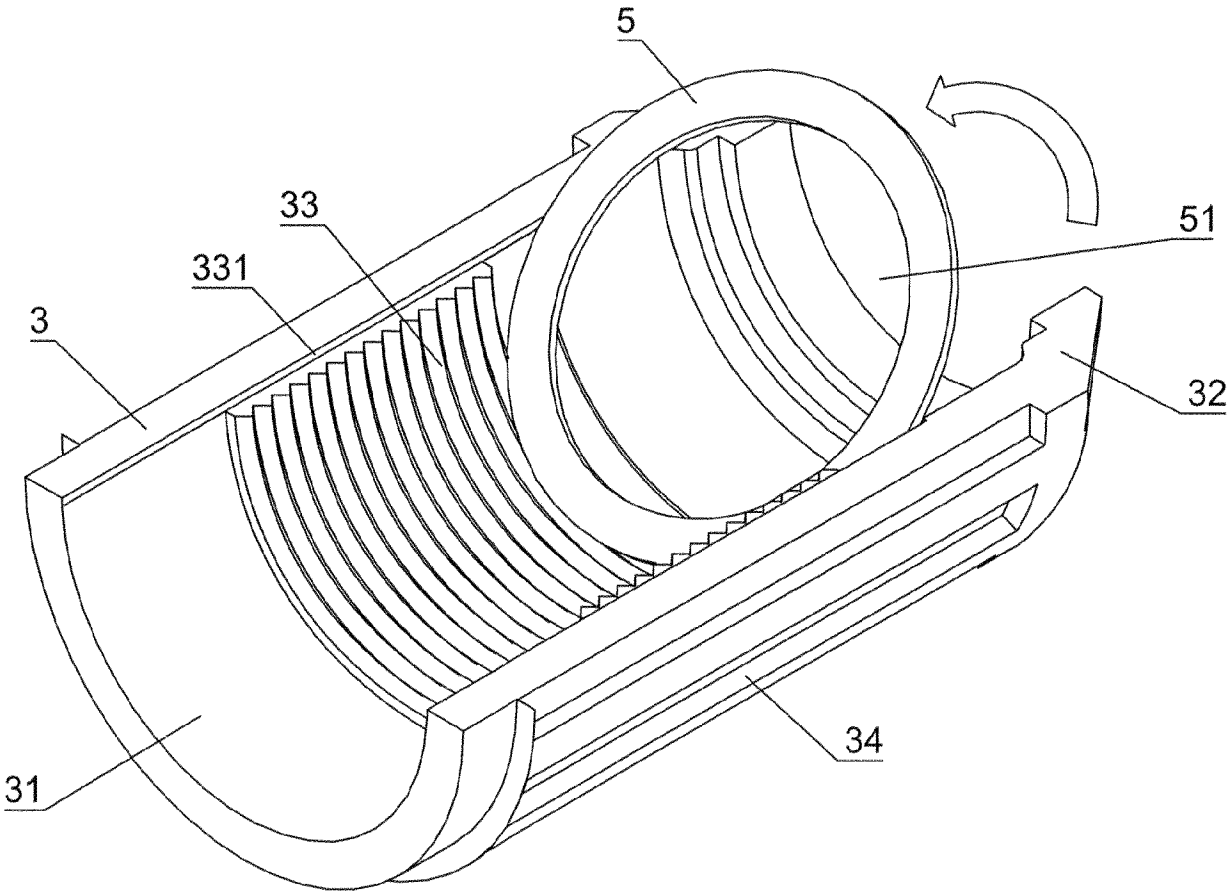
Fig. 6-C

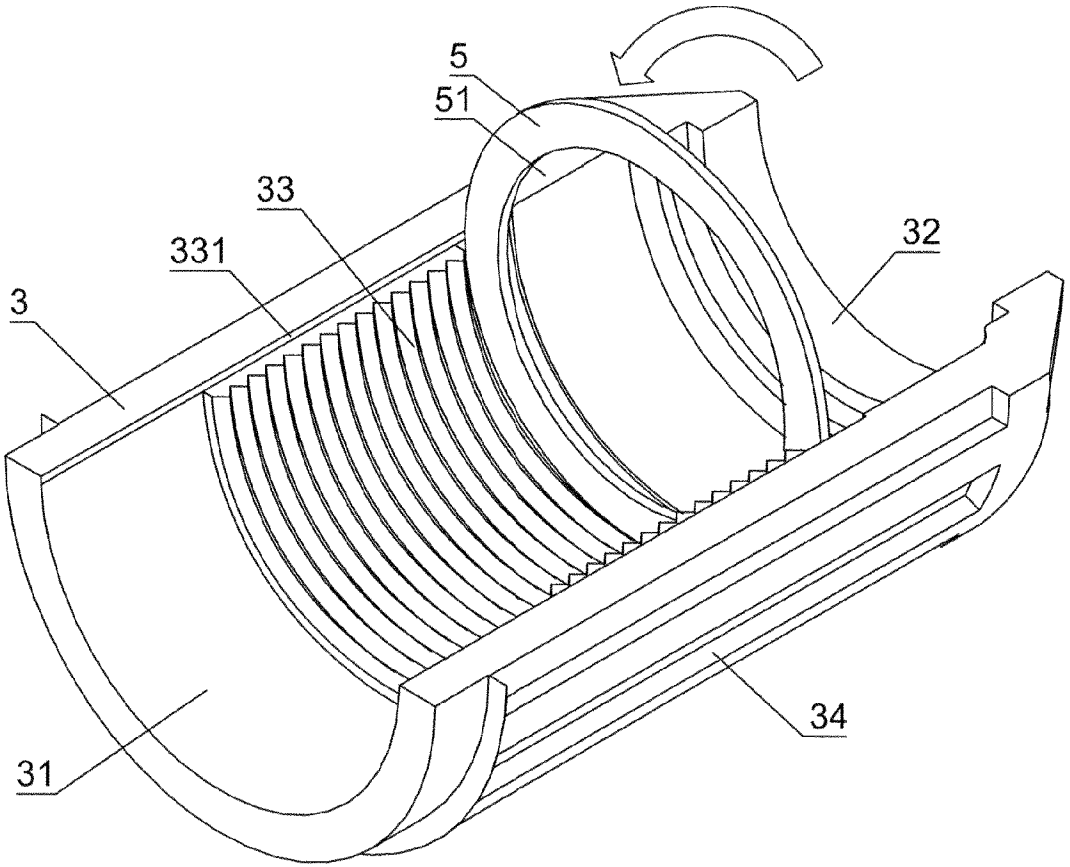
Fig. 6-D

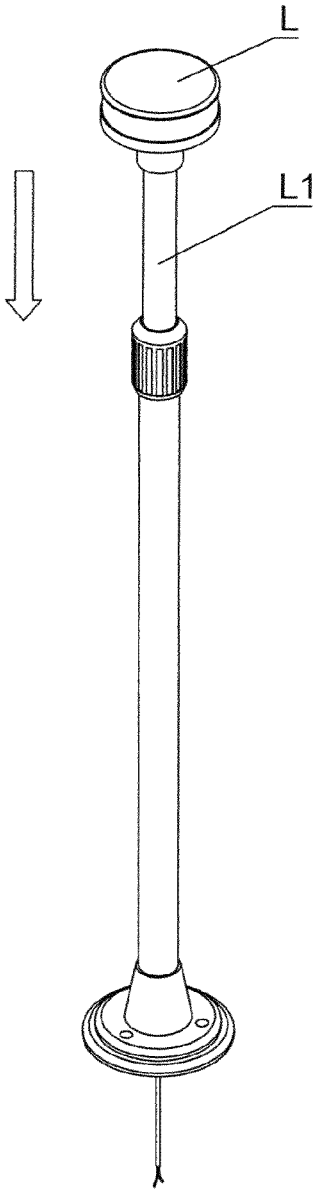
Fig. 7-A
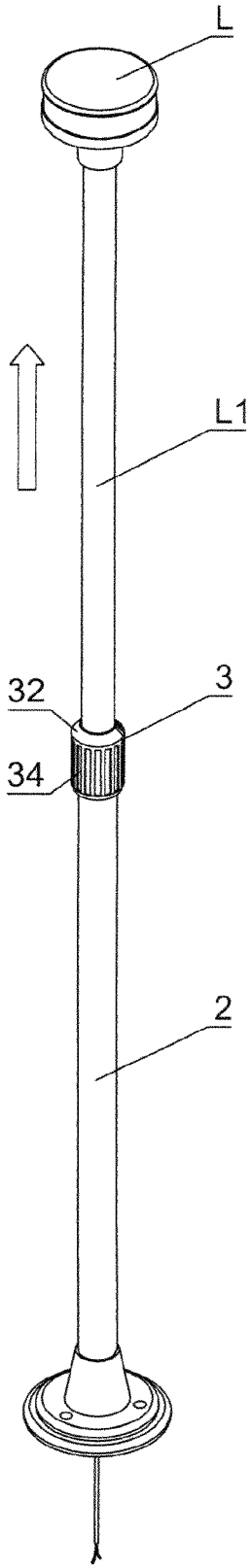
Fig. 7-B

TELESCOPIC PIPE STRUCTURE FOR A MARINE LIGHT

BACKGROUND OF THE INVENTION

1. Field of the Invention

The present invention relates to a telescopic pipe structure for a marine light, and more particularly to a positioning device composed of a rotatable lid, a resilient sleeve, and a metallic ring for changing the telescopic pipe in a fixed status or in an adjustable status by clockwise/counterclockwise rotation.

2. Description of the Prior Art

As shown in FIG. 1 and FIG. 2, a conventional telescopic pipe structure comprises a positioning seat 61 fitted on a fixed pipe 2, a tightening ring 62 inserted onto a locking ring 63, and a second pipe L1 inserted through the tightening ring 62. The locking ring 63 is screwed to the positioning seat 61 to be turned clockwise or counterclockwise for controlling engagement or disengagement of a slanting edge 621 at a lower section of the forcing ring 62 and an enlarged opening 611 formed at an upper section of the positioning seat 61 to be in a loosened status or in a tightened status. This structure has the shortcomings that the forcing ring 62 is exposed outside; the outer surfaces of the locking ring 63 and the positioning seat 61 are not even; the structure is complicated; and the appearance of the telescopic pipe is not perfect.

SUMMARY OF THE INVENTION

The primary objective of the present invention is to provide a telescopic pipe structure for a marine light, which has a simple structure to change the telescopic pipe in a fixed status or in an adjustable status.

According to the present invention, there is provided a telescopic pipe structure for a marine light, comprising a telescopic pipe and a positioning device, the telescopic pipe comprising a second pipe and a fixed pipe, the fixed pipe having an outer threaded portion at an upper end thereof for insertion of a lower section of the second pipe, the positioning device being adapted for controlling the telescopic pipe in a fixed status or in an adjustable status, the positioning device comprising a rotatable lid, a resilient sleeve, and a metallic ring, and characterized by:

the rotatable lid being in a cylinder shape and comprising a central accommodating space, a contracted opening at an upper end, an inner threaded portion at a central inner wall, a pair of grooves longitudinally formed at the inner threaded portion, and a skidproof surface around an outer wall thereof;

the resilient sleeve comprising a central through hole and a flange at an upper end thereof;

the metallic ring having a central hole;

thereby, the metallic ring holding against the upper end of the fixed pipe and a lower end of the resilient sleeve, respectively, the rotatable lid being turned clockwise or counterclockwise for changing the second pipe in a fixed status or in an adjustable status.

BRIEF DESCRIPTION OF THE DRAWINGS

FIGS. 6A through 6D are schematic views showing the operation of a metallic ring placed into the rotatable lid; and FIGS. 7A and 7B are perspective views showing a preferred embodiment of the present invention.

DETAILED DESCRIPTION OF THE PREFERRED EMBODIMENT

Embodiments of the present invention will now be described, by way of example only, with reference to the accompanying drawings.

Figure 1:
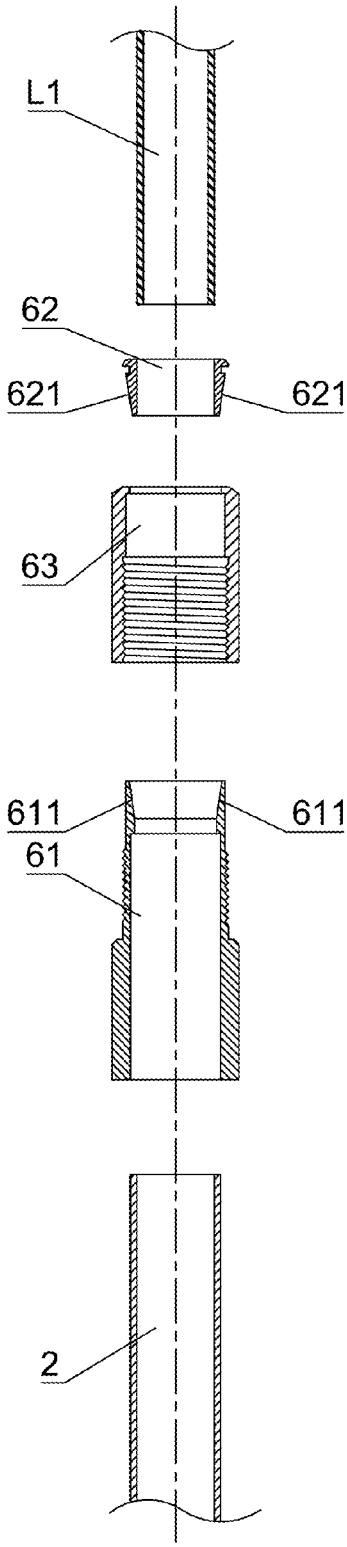
FIG. 1 is an exploded view of a conventional telescopic pipe.
Figure 2:
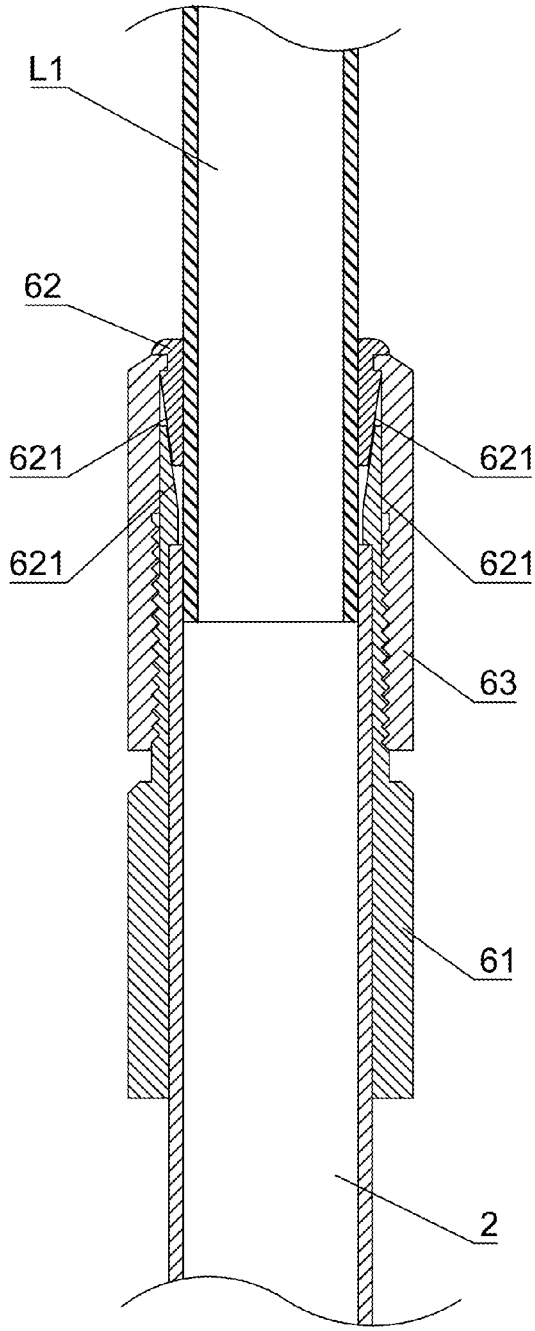
FIG. 2 is a perspective view of the conventional telescopic pipe.
Figure 3:
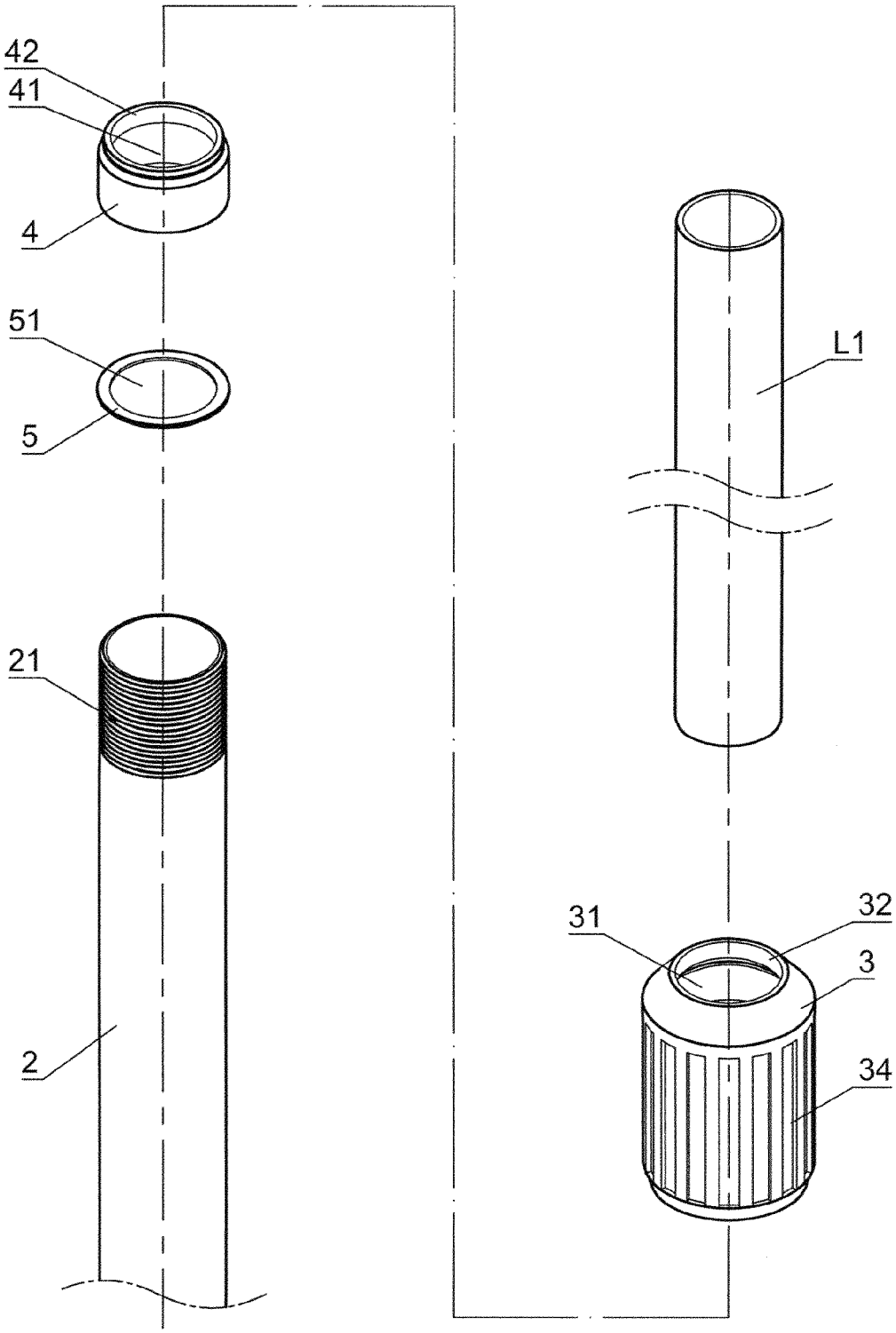
FIG. 3 is an exploded view of the present invention.
Figure 4:
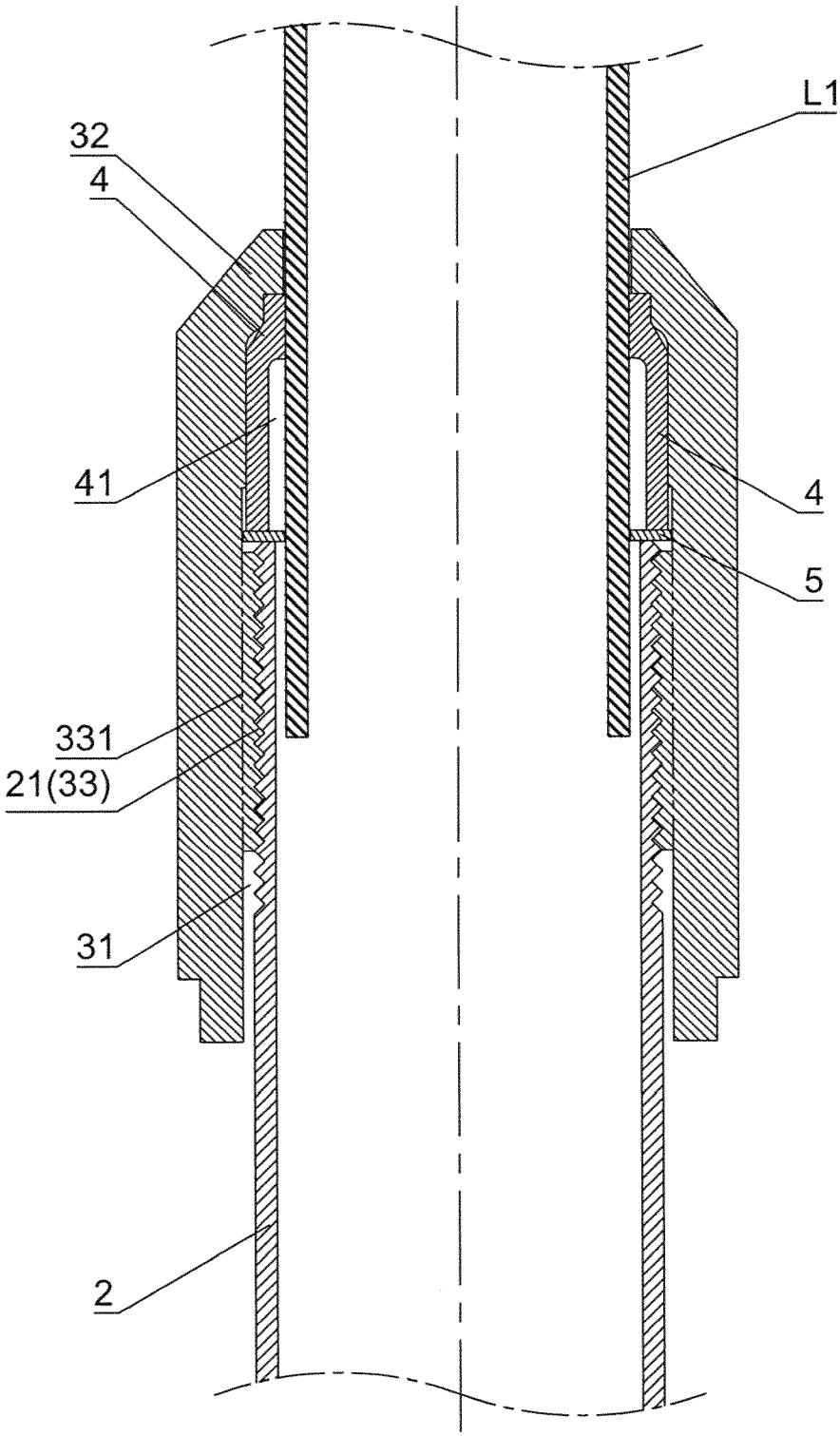
FIG. 4 is a cross-sectional view of the present invention.
Figure 5:
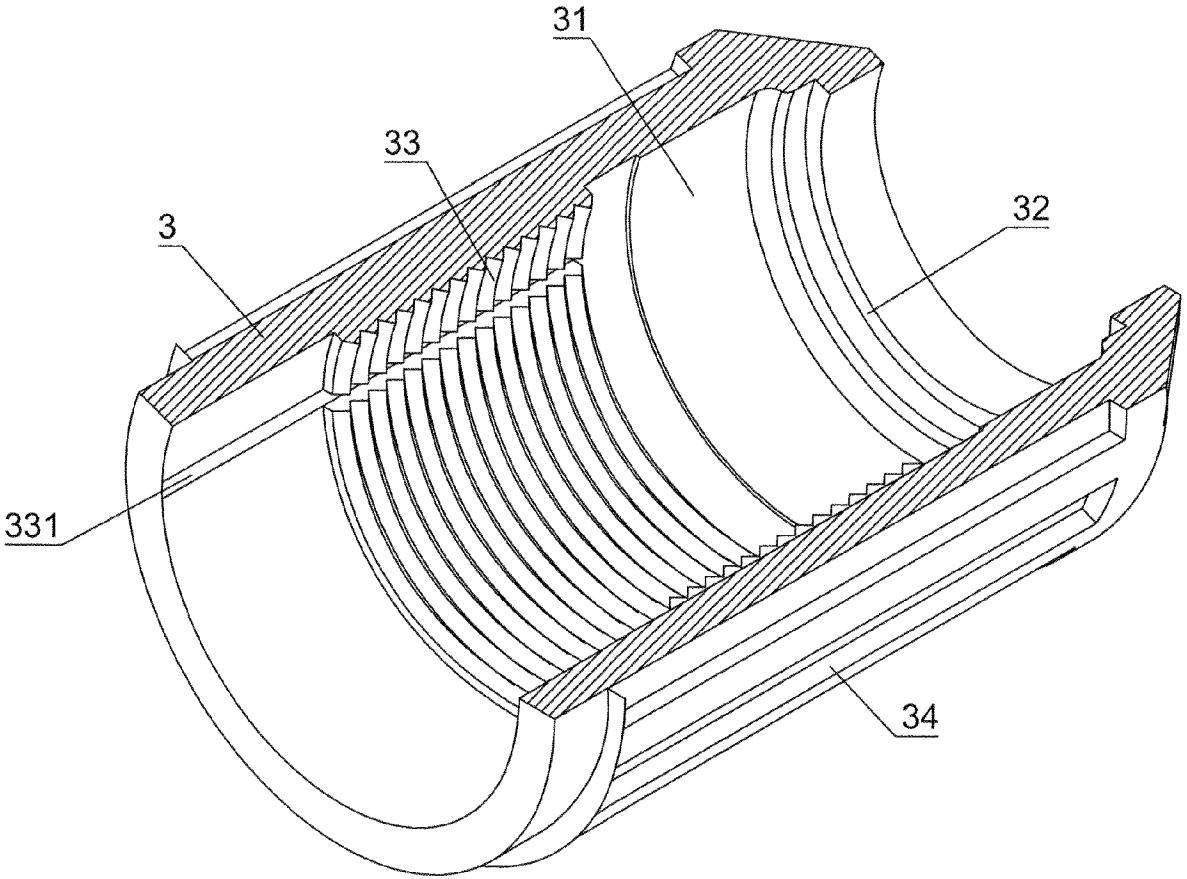
FIG. 5 is a cross-sectional and enlarged view of a rotatable lid of the present invention.

FIG. 3, FIG. 4, FIG. 5, FIG. 7A and FIG. 7B show a telescopic pipe structure for a marine light according to a preferred embodiment of the present invention. The marine light is a direction light L which is disposed on the top of a second pipe L1. The other end of the second pipe L1 is slidably connected to a fixed pipe 2 to form a telescopic pipe. The telescopic pipe structure comprises the second pipe L1, the fixed pipe 2, and a positioning device.

The fixed pipe 2 has an outer threaded portion 21 at an upper end thereof for insertion of a lower section of the second pipe L1.

The positioning device comprises a rotatable lid 3, a resilient sleeve 4, and a metallic ring 5.

The rotatable lid 3 is in a cylinder shape, and comprises a central accommodating space 31 to be coupled to the upper end of the fixed pipe 2, a contracted opening 32 at an upper end, an inner threaded portion 33 at a central inner wall for meshing with the outer threaded portion 21 of the fixed pipe 2, a pair of grooves 331 longitudinally formed at the inner threaded portion 33 for insertion of the metallic ring 5, and a skidproof surface 34 around an outer wall for enhancing rotating strength. The skidproof surface 34 may be in the form of rib, pellet, or mesh.

The resilient sleeve 4 is attached to an upper section of the inner wall of the rotatable lid 3, and comprises a central through hole 41 for insertion of the second pipe L1 and a flange 42 at an upper end corresponding to the contracted opening 32 of the rotatable lid 3. The resilient sleeve 4 is made of resilient material, such as rubber.

The metallic ring 5 has a central hole 51 for the second pipe L1 to be inserted and contracted into the fixed pipe 2. The metallic ring 5 is located between the fixed pipe 2 and the resilient sleeve 4 to hold against the top of the fixed pipe 2 and the bottom of the resilient sleeve 4, respectively.

The rotatable lid 3 is turned clockwise or counterclockwise for changing the second pipe L1 in a fixed status or in an adjustable status. FIGS. 6A through 6D show the operation of the metallic ring 5 placed into the rotatable lid 3. The metallic ring 5 is inserted along the pair of grooves 331, passing the threaded portion 33, into the accommodating space 31, and then turned at 90 degrees to engage with the top of the inner threaded portion 33. The resilient sleeve 4 is attached to the upper section of the inner wall of the rotatable lid 3. When the rotatable lid 3 is turned counterclockwise to move upwardly, the rotatable lid 3 will gradually disengage from the fixed pipe 2 and the metallic ring 5 urged by the resilient sleeve 4 will be loosened such that the resilient sleeve 4 and the second pipe L1 are in a loosened status so as to expand or retract the second pipe L1. When the rotatable lid 3 is turned clockwise to move downwardly, the metallic ring 5 will be urged by the top of the fixed pipe 2 to press the bottom of the resilient sleeve 4 with the flange 42 confined by the contracted opening 33 to tighten the periphery of the second pipe L1 such that the second pipe L1 is positioned in place. This provides a convenient and firm way.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A telescopic pipe structure for a marine light, comprising a telescopic pipe and a positioning device, the telescopic pipe comprising a second pipe and a fixed pipe, the fixed pipe having an outer threaded portion at an upper end thereof for insertion of a lower section of the second pipe, the positioning device being adapted for controlling the telescopic pipe in a fixed status or in an adjustable status, the positioning device comprising a rotatable lid, a resilient sleeve, and a metallic ring, and characterized by:

the rotatable lid being in a cylinder shape and comprising a central accommodating space, a contracted opening at an upper end, an inner threaded portion at a central inner wall, a pair of grooves longitudinally formed at the inner threaded portion each groove of the pair of grooves being located in a position directly opposite one another, and a skidproof surface around an outer wall thereof;

the resilient sleeve comprising a central through hole and a flange at an upper end thereof;

the metallic ring having a central hole, the metallic ring forms a continuous ring;

thereby, the metallic ring holding against the upper end of the fixed pipe and a lower end of the resilient sleeve, respectively, the rotatable lid being turned clockwise or counterclockwise for changing the second pipe in a fixed status or in an adjustable status, and wherein the pair of grooves are configured to allow the metallic ring to be inserted along the pair of grooves to thereby pass through the threaded portion into the central accommodating space and then be turned at 90 degrees to engage with the top of the inner threaded portion.

2. The telescopic pipe structure for a marine light as claimed in claim 1, wherein the skidproof surface is in the form of rib, pellet, or mesh.

3. The telescopic pipe structure for a marine light as claimed in claim 1, wherein the resilient sleeve is made of rubber.

* * * * *